US008721872B2

(12) United States Patent
Powers et al.

(10) Patent No.: US 8,721,872 B2
(45) Date of Patent: May 13, 2014

(54) PROCESSING OF ACID CONTAINING HYDROCARBONS

(75) Inventors: Donald H. Powers, Houston, TX (US); Robert S. Bridges, Friendswood, TX (US); Kenneth M. Webber, Friendswood, TX (US)

(73) Assignee: Equistar Chemicals, LP, Houston, TX (US)

( * ) Notice: Subject to any disclaimer, the term of this patent is extended or adjusted under 35 U.S.C. 154(b) by 983 days.

(21) Appl. No.: 12/383,990

(22) Filed: Mar. 31, 2009

(65) Prior Publication Data

US 2010/0243525 A1 Sep. 30, 2010

(51) Int. Cl.
*C10G 7/00* (2006.01)

(52) U.S. Cl.
USPC ..... 208/92; 585/648; 208/263; 208/237; 208/189; 208/85; 208/106

(58) Field of Classification Search
USPC ..... 585/648; 208/92, 263, 237, 189, 85, 208/106, 265, 82
See application file for complete search history.

(56) References Cited

U.S. PATENT DOCUMENTS 5,820,750 A 10/1998 Blum et al.
5,914,030 A * 6/1999 Bearden et al. ..... 208/263
6,743,961 B2 * 6/2004 Powers ..... 585/648
7,019,187 B2 3/2006 Powers
7,396,449 B2 7/2008 Powers
7,404,889 B1 7/2008 Powers
2004/0039240 A1 2/2004 Powers
2004/0054247 A1 3/2004 Powers
2007/0066860 A1 * 3/2007 Buchanan et al. ..... 585/648
2007/0208207 A1 * 9/2007 Powers ..... 585/648
2008/0283445 A1 11/2008 Powers
2010/0243523 A1 9/2010 Powers
2010/0243524 A1 9/2010 Powers

OTHER PUBLICATIONS

Energy Intelligence Group Inc.: "The Crude Oils and Their Key Characteristics," *International Crude Oil Market Handbook 2009* 115, XP002587269.
Anonymous: "Crude Oil Price Differentials and Differences in Oil Qualities: A Statistical Analysis," *ESMAP Technical Paper 081*, Oct. 31, 2005, pp. 23-24, XP002587265.
Naphthenic Acids, Kirk-Othmer Encyclopedia of Chemical Technology, Dec. 31, 1998, John Wiley & Sons, pp. 1-10, XP002587512.
Ismet Dzidic et al., Determination of Naphthenic Acids in California Crudes and Refinery Wastewaters by Fluoride Ion Chemical Ionization Mass Spectrometry, Analytical Chemistry 1988, vol. 60, No. 13, pp. 1318-1323, XP002587513.
Kuangnan Qian et al., Resolution and Identification of Elemental Compositions for More than 3000 Crude Acids in Heavy Petroleum by Negative-Ion Microelectrospray High-Field Fourier Transform Ion Cyclotron Resonance Mass Spectrometry, Energy & Fuels, 2001, vol. 15, pp. 1505-1511, XP002587514.

* cited by examiner

*Primary Examiner* — In Suk Bullock
*Assistant Examiner* — Sharon Pregler

(57) ABSTRACT

A method for thermally cracking an organic acid containing hydrocarbonaceous feed wherein the feed is first processed in a vaporization step, followed by thermal cracking.

8 Claims, 1 Drawing Sheet

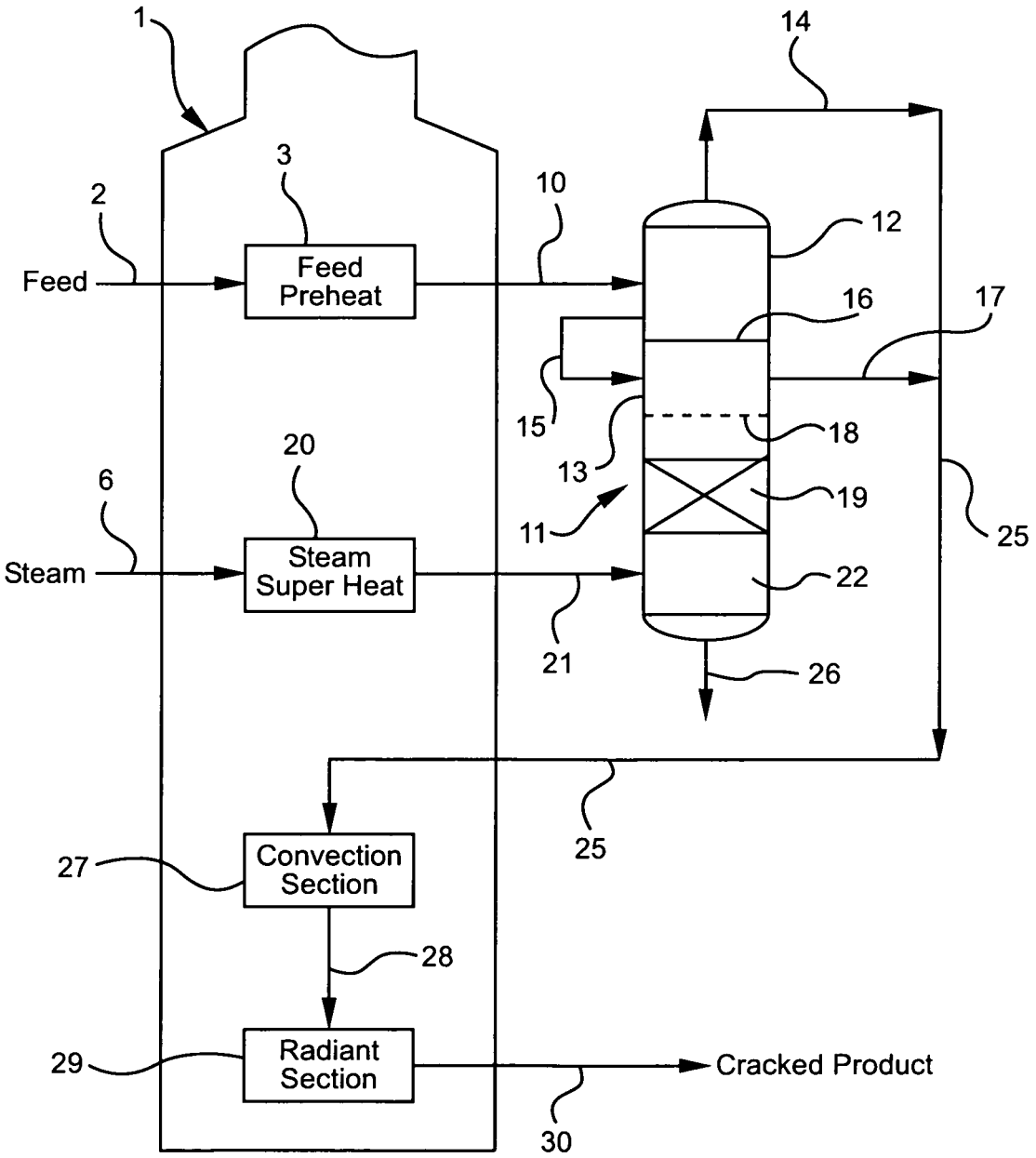
1
2
Feed
3
Feed Preheat
10
14
12
16
17
15
13
18
11
19
25
6
Steam
20
Steam Super Heat
21
22
26
25
27
Convection Section
28
29
Radiant Section
Cracked Product
30

PROCESSING OF ACID CONTAINING HYDROCARBONS

BACKGROUND OF THE INVENTION

1. Field of the Invention

This invention relates to the thermal cracking of acid containing hydrocarbon feedstocks using a vaporization unit in combination with at least one thermal cracking furnace.

2. Description of the Prior Art

Thermal cracking (pyrolysis) of hydrocarbons is a petrochemical process that is widely used to produce olefins such as ethylene, propylene, butenes, butadiene, and aromatics such as benzene, toluene, and xylenes.

Basically, a hydrocarbon containing feedstock is mixed with steam which serves as a diluent to keep the hydrocarbon molecules separated. The steam/hydrocarbon mixture is preheated in the convection zone of the furnace to from about 900 to about 1,000 degrees Fahrenheit (F.), and then enters the reaction (radiant) zone where it is very quickly heated to a severe hydrocarbon thermal cracking temperature in the range of from about 1,400 to about 1,550 F. Thermal cracking is accomplished without the aid of any catalyst.

This process is carried out in a pyrolysis furnace (steam cracker) at pressures in the reaction zone ranging from about 10 to about 30 psig. Pyrolysis furnaces have internally thereof a convection section (zone) and a separate radiant section (zone). Preheating functions are primarily accomplished in the convection section, while severe cracking mostly occurs in the radiant section.

After thermal cracking, depending on the nature of the primary feed to the pyrolysis furnace, the effluent from that furnace can contain gaseous hydrocarbons of great variety, e.g., from one to thirty-five carbon atoms per molecule. These gaseous hydrocarbons can be saturated, monounsaturated, and polyunsaturated, and can be aliphatic, alicyclics, and/or aromatic. The cracked gas can also contain significant amounts of molecular hydrogen (hydrogen).

The cracked product is then further processed in the olefin production plant to produce, as products of the plant, various separate individual streams of high purity such as hydrogen, ethylene, propylene, mixed hydrocarbons having four carbon atoms per molecule, fuel oil, and pyrolysis gasoline. Each separate individual stream aforesaid is a valuable commercial product in its own right. Thus, an olefin production plant currently takes a part (fraction) of a whole crude stream or condensate, and generates there from a plurality of separate, valuable products.

Thermal cracking came into use in 1913, and was first applied to gaseous ethane as the primary feed to the cracking furnace for the purpose of making ethylene. Since that time the industry has evolved to using heavier and more complex hydrocarbonaceous gaseous and/or liquid feeds as the primary feed for the cracking furnace. Such feeds can now employ a fraction of whole crude or condensate which is essentially totally vaporized while thermally cracking same. The cracked product can contain, for example, about 1 weight percent (wt. %) hydrogen, about 10 wt. % methane, about 25 wt. % ethylene, and about 17 wt. % propylene, all wt. % being based on the total weight of that product, with the remainder consisting mostly of other hydrocarbon molecules having from 4 to 35 carbon atoms per molecule.

Natural gas and whole crude oil(s) were formed naturally in a number of subterranean geologic formations (formations) of widely varying porosities. Many of these formations were capped by impervious layers of rock. Natural gas and whole crude oil (crude oil) also accumulated in various stratigraphic traps below the earth's surface. Vast amounts of both natural gas and/or crude oil were thus collected to form hydrocarbon bearing formations at varying depths below the earth's surface. Much of this natural gas was in close physical contact with crude oil, and, therefore, absorbed a number of lighter molecules from the crude oil.

When a well bore is drilled into the earth and pierces one or more of such hydrocarbon bearing formations, natural gas and/or crude oil can be recovered through that well bore to the earth's surface.

The terms "whole crude oil" and "crude oil" as used herein means liquid (at normally prevailing conditions of temperature and pressure at the earth's surface) crude oil as it issues from a wellhead separate from any natural gas that may be present, and excepting any treatment such crude oil may receive to render it acceptable for transport to a crude oil refinery and/or conventional distillation in such a refinery. This treatment would include such steps as desalting. Thus, it is crude oil that is suitable for distillation or other fractionation in a refinery, but which has not undergone any such distillation or fractionation. It could include, but does not necessarily always include, non-boiling entities such as asphaltenes or tar. As such, it is difficult if not impossible to provide a boiling range for whole crude oil. Accordingly, whole crude oil could be one or more crude oils straight from an oil field pipeline and/or conventional crude oil storage facility, as availability dictates, without any prior fractionation thereof.

Natural gas, like crude oil, can vary widely in its composition as produced to the earth's surface, but generally contains a significant amount, most often a major amount, i.e., greater than about 50 weight percent (wt. %), methane. Natural gas often also carries minor amounts (less than about 50 wt. %), often less than about 20 wt. %, of one or more of ethane, propane, butane, nitrogen, carbon dioxide, hydrogen sulfide, and the like. Many, but not all, natural gas streams as produced from the earth can contain minor amounts (less than about 50 wt. %), often less than about 20 wt. %, of hydrocarbons having from 5 to 12, inclusive, carbon atoms per molecule (C5 to C12) that are not normally gaseous at generally prevailing ambient atmospheric conditions of temperature and pressure at the earth's surface, and that can condense out of the natural gas once it is produced to the earth's surface. All wt. % are based on the total weight of the natural gas stream in question.

When various natural gas streams are produced to the earth's surface, a hydrocarbon composition often naturally condenses out of the thus produced natural gas stream under the then prevailing conditions of temperature and pressure at the earth's surface where that stream is collected. There is thus produced a normally liquid hydrocarbonaceous condensate separate from the normally gaseous natural gas under the same prevailing conditions. The normally gaseous natural gas can contain methane, ethane, propane, and butane. The normally liquid hydrocarbon fraction that condenses from the produced natural gas stream is generally referred to as "condensate," and generally contains molecules heavier than butane (C5 to about C20 or slightly higher). After separation from the produced natural gas, this liquid condensate fraction is processed separately from the remaining gaseous fraction that is normally referred to as natural gas.

Thus, condensate recovered from a natural gas stream as first produced to the earth's surface is not the exact same material, composition wise, as natural gas (primarily methane). Neither is it the same material, composition wise, as crude oil. Condensate occupies a niche between normally gaseous natural gas and normally liquid whole crude oil.

Condensate contains hydrocarbons heavier than normally gaseous natural gas, and a range of hydrocarbons that are at the lightest end of whole crude oil.

Condensate, unlike crude oil, can be characterized by way of its boiling point range. Condensates normally boil in the range of from about 100 to about 650 F. With this boiling range, condensates contain a wide variety of hydrocarbonaceous materials. These materials can include compounds that make up fractions that are commonly referred to as naphtha, kerosene, diesel fuel(s), and gas oil (fuel oil, furnace oil, heating oil, and the like).

Atmospheric residuum ("resid," "residua") obtained from a conventional atmospheric thermal distillation tower can have a wide boiling range, particularly when mixtures of residua are employed, but will generally be in a boiling range of from about 600 F to the boiling end point where only non-boiling entities remain. These resids are primarily composed of a gas oil component boiling in the range of from about 600 to about 1,000 F and a heavier fraction boiling in a temperature range of from about 1,000 F up to its end boiling point where only non-boiling entities remain.

In contrast to an atmospheric tower, a vacuum assisted thermal distillation tower (vacuum tower) typically separates this gas oil component from its associated heavier fraction aforesaid, thus freeing the gas oil fraction for separate recovery and use elsewhere.

The olefin production industry is now progressing beyond the use of fractions of crude oil or condensate (gaseous and/or liquid) as the primary feed for a cracking furnace to the use of whole crude oil, crude oil residuum, and/or condensate itself as a significant part of that feed.

U.S. Pat. No. 6,743,961 (hereafter "USP '961") recently issued to Donald H. Powers. This patent relates to cracking whole crude oil by employing a vaporization/mild cracking zone that contains packing. This zone is operated in a manner such that the liquid phase of the whole crude that has not already been vaporized is held in that zone until cracking/vaporization of the more tenacious hydrocarbon liquid components is maximized. This allows only a minimum of solid residue formation which residue remains behind as a deposit on the packing. This residue is later burned off the packing by conventional steam air decoking, ideally during the normal furnace decoking cycle, see column 7, lines 50-58 of that patent. Thus, the second zone 9 of that patent serves as a trap for components, including hydrocarbonaceous materials, of the crude oil feed that cannot be cracked or vaporized under the conditions employed in the process, see column 8, lines 60-64 of that patent.

U.S. Pat. No. 7,019,187, issued to Donald H. Powers, is directed to the process disclosed in USP '961, but employs a mildly acidic cracking catalyst to drive the overall function of the vaporization/mild cracking unit more toward the mild cracking end of the vaporization (without prior mild cracking)—mild cracking (followed by vaporization) spectrum.

U.S. Pat. No. 7,404,889, issued to Donald H. Powers, is directed to the process disclosed in USP '961, but uses atmospheric residuum as the dominant liquid hydrocarbonaceous feed for the vaporization unit and furnace.

The disclosures of the foregoing patents, in their entirety, are incorporated herein by reference.

U.S. patent application Ser. No. 11/365,212, filed Mar. 1, 2006, having common inventorship and assignee with USP '961, is directed to the use of condensate as the dominant liquid hydrocarbonaceous feed for the vaporization unit and furnace.

U.S. Application Publication 2007/0066860 John S. Buchanan et al., published Mar. 22, 2007, discloses the thermal cracking of crudes that have a high Total Acid Number (TAN) using a flash drum unit in combination with a thermal cracking furnace. This Publication discloses that its flash drum effects only a physical separation of the two phases (vapor and liquid) entering that drum. That is to say, the composition of the vapor phase leaving the flash drum is disclosed to be substantially the same as the composition of the vapor phase entering that drum. Likewise, the composition of the liquid phase leaving the same flash drum is disclosed to be substantially the same as the composition of the liquid phase entering that drum. Preferred high TAN feeds are disclosed to be crude or a feed stream that has previously been subjected to a refinery process to remove resid. Thus, Buchanan et al. teach away from the use of resids in its process.

The Publication to Buchanan et al. further discloses that the naphthenic acids present in its high TAN feeds are substantially converted to CO, $CO_2$, and lower molecular weight acids such as formic, acetic, propionic, and butyric acids.

Organic acids, including naphthenic acids, are present to a growing extent in hydrocarbonaceous feeds such as crude oil, and are becoming a problem for crude oil refining processors. Naphthenic acids are often singled out for consideration because they are particularly corrosive.

Most refineries are unable to process crude oils with total acid numbers (TAN) greater than 1.0 due to the highly corrosive nature of the acids, particularly naphthenic acids, above 400 F. As more and more of the World's hydrocarbon production capacity is required to meet demand, the use of these acid containing feedstocks, particularly crude oils, is required to meet worldwide demand growth.

By this invention, organic acid containing feedstocks such as whole crude oil, and condensate, and organic acid containing fractions of crude oil, e.g., residua, are processed by a combination of a vaporization unit and at least one thermal cracking furnace not only to reduce (convert or transform) the original acid content, but also to form additional thermal cracking feed from those feedstocks.

SUMMARY OF THE INVENTION

In accordance with this invention, there is provided a unique process for handling organic acid containing feedstocks that employs a vaporization unit in combination with at least one thermal cracking furnace to generate additional cracking feed by way of the vaporization unit while reducing by way of the cracking operation the organic acid content originally present in those feedstocks.

DESCRIPTION OF THE DRAWING

FIG. 1 shows one vaporization/cracking system useful in the process of this invention.

DETAILED DESCRIPTION OF THE INVENTION

The terms "hydrocarbon," "hydrocarbons," and "hydrocarbonaceous" as used herein do not mean materials strictly or only containing hydrogen atoms and carbon atoms. Such terms include materials that are hydrocarbonaceous in nature in that they primarily or essentially are composed of hydrogen and carbon atoms, but can contain other elements such as oxygen, sulfur, nitrogen, metals, inorganic salts, and the like, even in significant amounts. These terms include crude oil itself or fractions thereof such as gas oil, residuum, and the like. They also include natural gas condensate.

The term "gaseous" as used in this invention means one or more gases in an essentially vaporous state, for example, steam alone, a mixture of steam and hydrocarbon vapor, and the like.

Coke, as used herein, means a high molecular weight carbonaceous solid, and includes compounds formed from the condensation of polynuclear aromatics.

An olefin producing plant useful with this invention would include a pyrolysis (thermal cracking) furnace for initially receiving and thermally cracking the feed. Pyrolysis furnaces for steam cracking of hydrocarbons heat by means of convection and radiation, and comprise a series of preheating, circulation, and cracking tubes, usually bundles of such tubes, for preheating, transporting, and cracking the hydrocarbon feed. The high cracking heat is supplied by burners disposed in the radiant section (sometimes called "radiation section") of the furnace. The waste gas from these burners is circulated through the convection section of the furnace to provide the heat necessary for preheating the incoming hydrocarbon feed. The convection and radiant sections of the furnace are joined at the "cross-over," and the tubes referred to hereinabove carry the hydrocarbon feed from the interior of one section to the interior of the next.

In a typical furnace, the convection section can contain multiple sub-zones. For example, the feed can be initially preheated in a first upper sub-zone, boiler feed water heated in a second sub-zone, mixed feed and steam heated in a third sub-zone, steam superheated in a fourth sub-zone, and the final feed/steam mixture split into multiple sub-streams and preheated in a lower (bottom) or fifth sub-zone. The number of sub-zones and their functions can vary considerably. Each sub-zone can carry a plurality of conduits carrying furnace feed there through, many of which are sinusoidal in configuration. The convection section operates at much less severe operating conditions than the radiant section.

Cracking furnaces are designed for rapid heating in the radiant section starting at the radiant tube (coil) inlet where reaction velocity constants are low because of low temperature. Most of the heat transferred simply raises the hydrocarbons from the inlet temperature to the reaction temperature. In the middle of the coil, the rate of temperature rise is lower but the cracking rates are appreciable. At the coil outlet, the rate of temperature rise increases somewhat but not as rapidly as at the inlet. The rate of disappearance of the reactant is the product of its reaction velocity constant times its localized concentration. At the end of the coil, reactant concentration is low and additional cracking can be obtained by increasing the process gas temperature.

Steam dilution of the feed hydrocarbon lowers the hydrocarbon partial pressure, enhances olefin formation, and reduces any tendency toward coke formation in the radiant tubes.

Cracking furnaces typically have rectangular fireboxes with upright tubes centrally located between radiant refractory walls. The tubes are supported from their top.

Firing of the radiant section is accomplished with wall or floor mounted burners or a combination of both using gaseous or combined gaseous/liquid fuels. Fireboxes are typically under slight negative pressure, most often with upward flow of flue gas. Flue gas flow into the convection section is established by at least one of natural draft or induced draft fans.

Radiant coils are usually hung in a single plane down the center of the fire box. They can be nested in a single plane or placed parallel in a staggered, double-row tube arrangement. Heat transfer from the burners to the radiant tubes occurs largely by radiation, hence the term "radiant section," where the hydrocarbons are heated to from about 1,400 F to about 1,550 F and thereby subjected to severe cracking, and coke formation.

The initially empty radiant coil is, therefore, a fired tubular chemical reactor. Hydrocarbon feed to the furnace is preheated to from about 900 F to about 1,000 F in the convection section by convectional heating from the flue gas from the radiant section, steam dilution of the feed in the convection section, or the like. After preheating, in a conventional commercial furnace, the feed is ready for entry into the radiant section.

The cracked gaseous hydrocarbons leaving the radiant section are rapidly reduced in temperature to prevent destruction of the cracking pattern. Cooling of the cracked gases before further processing of same downstream in the olefin production plant recovers a large amount of energy as high pressure steam for re-use in the furnace and/or olefin plant. This is often accomplished with the use of transfer-line exchangers that are well known in the art.

With a liquid hydrocarbon feedstock downstream processing, although it can vary from plant to plant, typically employs an oil quench of the furnace effluent after heat exchange of same in, for example, the transfer-line exchanger aforesaid. Thereafter, the cracked hydrocarbon stream is subjected to primary fractionation to remove heavy liquids, followed by compression of uncondensed hydrocarbons, and acid gas and water removal there from. Various desired products are then individually separated, e.g., ethylene, propylene, a mixture of hydrocarbons having four carbon atoms per molecule, fuel oil, pyrolysis gasoline, and a high purity hydrogen stream.

FIG. 1 shows a vaporization/cracking system that can operate on organic acid containing whole crude oil, condensate, fractions of whole crude oil including residua, particularly atmospheric residua, and mixtures there of as the dominant (primary) system feed.

FIG. 1 is very diagrammatic for sake of simplicity and brevity since, as discussed above, actual furnaces are complex structures.

Total Acid Number or TAN is a measure of the organic acid content of a hydrocarbonaceous material. Such organic acids include, but are not limited to, naphthenic acids.

TAN is determined by ASTM method D-644 and takes the units of milligrams (mg) KOH/kilogram (kg) of hydrocarbonaceous material being tested. For sake of brevity, hereinafter the method of measurement and units are not repeated.

Organic acid containing feed streams to which this invention is applicable include any hydrocarbonaceous material such as crude oil itself, one or more fractions of crude oil including residuum, particularly atmospheric resid, natural gas condensate, and mixtures of two or more thereof.

Carboxylic acid species are the most corrosive class of acids present in the foregoing feed streams. Within the carboxylic acid class of acids, the naphthenic acid sub-group is the most corrosive and problematic for the operation of the cracking plant as a whole in respect of minimizing the corrosion of operating equipment.

The atmospheric resid feed employed in this invention can be from a single or multiple sources, and, therefore, can be a single resid or a mixture of two or more residua with or without other materials such as crude oil and condensate. Atmospheric resid useful in this invention can have a wide boiling range, particularly when mixtures of residua are employed, but will generally be in a boiling range of from about 600 F to the boiling end point where only non-boiling entities remain.

Atmospheric resid bottoms from an atmospheric thermal distillation tower are primarily composed of a gas oil component boiling in the range of from about 600 to about 1,000 F and a heavier fraction boiling in a temperature range of from about 1,000 F up to its end boiling point where only non-boiling entities remain.

A vacuum assisted thermal distillation tower (vacuum tower) typically separates the gas oil component from its associated heavier fraction aforesaid, thus providing a different composition resid.

The amount of resid employed in feed 2 pursuant to this invention can be a significant component of the overall feed 2. The resid component can be at least about 20 wt. % of the total weight of feed 2, but it is not necessarily strictly within this range.

Depending on the specific physical and chemical characteristics of the resid added to feed 2, other materials can be added to that feed. Such additional materials can include light gasoline, naphtha, natural gasoline and/or condensate. Naphtha can be employed in the form of full range naphtha, light naphtha, medium naphtha, heavy naphtha, or mixtures of two or more thereof. The light gasoline can have a boiling range of from that of pentane (C5) to about 158 F. Full range naphtha, which includes light, medium, and heavy naphtha fractions, can have a boiling range of from about 158 to about 350 F. The boiling ranges for the light, medium, and heavy naphtha fractions can be, respectively, from about 158 to about 212 F, from about 212 to about 302 F, and from about 302 to about 350 F.

The amount of light material(s) thus deliberately added to the resid in feed 2 can vary widely depending on the desires of the operator, but the resid in feed 2, if present, can remain a significant component of the feed 2 that is in line 10 and feeds vaporization unit 11.

FIG. 1 shows a liquid cracking furnace 1 wherein a high TAN hydrocarbonaceous primary feed 2 is passed into an upper feed preheat sub-zone 3 in the upper, cooler reaches of the convection section of furnace 1. Steam 6 is also superheated in an upper level of the convection section of the furnace.

The pre-heated cracking feed stream is then passed by way of pipe (line) 10 to a vaporization unit 11 which is separated into an upper vapor vaporization zone 12 and a lower vaporization zone 13. This unit 11 achieves primarily (predominately) vaporization of at least a significant portion of the materials, e.g., naphtha and gasoline boiling range and lighter fractions, that remain in the liquid state after the pre-heating step 3.

Gaseous materials that are associated with the preheated feed as received by unit 11, and additional gaseous materials, both hydrocarbonaceous and acidic, that may be formed under the particular conditions then prevailing in zone 12, are removed from zone 12 by way of line 14. Thus, line 14 carries away essentially all the lighter hydrocarbon vapors, e.g., naphtha and gasoline boiling range and lighter, that are present in zone 12, and can carry away some vaporous acid species. Liquid distillate present in zone 12, with or without some liquid gasoline and/or naphtha, is removed there from via line 15 and passed into the upper interior of lower zone 13.

Zones 12 and 13, in this particular embodiment, are separated from fluid communication with one another by an impermeable wall 16, which can be a solid tray. Line 15 represents external fluid down flow communication between zones 12 and 13. In lieu thereof, or in addition thereto, zones 12 and 13 can have internal fluid communication there between by modifying wall 16 to be at least in part liquid permeable by use of one or more trays designed to allow liquid to pass down into the interior of zone 13 and vapor up into the interior of zone 12. For example, instead of an impermeable wall 16, a chimney tray could be used in which case liquid within unit 11 would flow internally down into section 13 instead of externally of unit 11 via line 15. In this internal down flow case, distributor 18 becomes optional.

By whatever way liquid is removed from zone 12 to zone 13, that liquid moves downwardly into zone 13, and thus can encounter at least one liquid distribution device 18. Device 18 evenly distributes liquid across the transverse cross section of unit 11 so that the liquid will flow uniformly across the width of the tower into contact with packing 19.

Steam 6 passes through superheat sub-zone 20, and then, via line 21 in to a lower portion 22 of zone 13 below packing 19. In packing 19 liquid and steam from line 21 intimately mix with one another thus vaporizing some of liquid 15. This newly formed hydrocarbonaceous vapor, along with steam 21, is removed from zone 13 via line 17 and can be added to the vapor in line 14 to form a combined hydrocarbon vapor product in line 25. Stream 25 can contain essentially hydrocarbon vapor from feed 2, e.g., gasoline, naphtha, middle distillates, gas oils, and steam.

Stream 17 thus represents a part of feed stream 2 plus steam 21 less hydrocarbon liquid remainder from feed 2 that is present in bottoms stream 26. Stream 25 contains organic acid species that were present in the original feedstock 2. Stream 25 is passed through a header (not shown) whereby stream 25 is split into multiple sub-streams and passed through multiple conduits (not shown) into convection section pre-heat sub-zone 27 of furnace 1. Section 27 is in a lower, and therefore hotter, section of furnace 1. Section 27 is used for preheating stream 25 to a temperature, aforesaid, suitable for cracking in radiant zone 29.

After substantial heating in section 27, stream 25, including organic acid species, passes by way of line 28 into radiant section sub-zone 29. Again, the multiple, individual streams that normally pass from sub-zone 27 to and through sub-zone 29 are represented as a single flow stream 28 for sake of brevity.

In radiant firebox 29 of furnace 1, feed from line 28, which contains numerous varying hydrocarbon components, including acid species, is subjected to severe thermal cracking conditions as aforesaid. These cracking conditions convert, or otherwise transform, a significant amount, even preponderance, of the naphthenic acids present into carbon monoxide (CO), carbon dioxide ($CO_2$), and lower molecular weight acids (formic, acetic, propionic, and butyric acids).

The cracked product leaves radiant firebox 29 by way of line 30 for further processing in the remainder of the olefin plant downstream of furnace 1 as described hereinabove and shown in detail in USP '961.

When using crude oil, condensate, resid, and the like, as the significant component(s) of feed 2, substantial amounts of distillates containing organic acids are ultimately vaporized in unit 11, particularly zone 13, passed into furnace 1, and cracked thereby converting such distillates into lighter components.

Feed 2 can enter furnace 1 at a temperature of from about ambient up to about 300 F at a pressure from slightly above atmospheric up to about 100 psig (hereafter "atmospheric to 100 psig").

Feed 2 can enter zone 12 via line 10 at a temperature of from about ambient to about 750 F, e.g., from about 500 to about 750 F, at a pressure of from atmospheric to 100 psig.

Stream 14 can be essentially all hydrocarbon vapor formed from feed 2 and is at a temperature of from about ambient to about 700 F at a pressure of from atmospheric to 100 psig.

Stream 14 may or may not contain some of the acid species that were originally present in feed 2.

Stream 15 can be essentially all the remaining liquid from feed 2 less that which was vaporized in pre-heater 3 and zone 12, and is at a temperature of from about ambient to about 700 F at a pressure of from slightly above atmospheric up to about 100 psig (hereafter "atmospheric to 100 psig").

Zone 12 can serve as a physical separation zone like that of the flash drum in the publication of Buchanan et al. discussed hereinabove, and, in addition, can be operated at conditions that serve to cause additional vaporization of liquid hydrocarbon that has entered zone 12 by way of line 10.

Zone 13 is operated at a temperature of from about 700 to about 1,100 F and thereby forms a substantial amount of additional vaporous hydrocarbons from the liquid it receives from zone 12 by way of line 15.

Thus, vaporization unit 11, in addition to vaporizing organic acids present in original feed 2, forms substantial amounts of additional vaporous hydrocarbons from the liquid present in the pre-heated feed stream 10.

Accordingly, the chemical composition of the vapor phase leaving unit 11 by way of lines 14 and 17 is substantially different from the chemical composition of the vapor phase entering unit 11 by way of line 10. Similarly, the chemical composition of the liquid phase leaving unit 11 by way of line 26 is substantially different from the chemical composition of the liquid phase entering unit 11 by way of line 10. That is to say unit 11 does more than just effect a physical separation of the two phases (liquid and vapor) that enters unit 11 by way of line 10.

The combination of streams 14 and 17, as represented by stream 25, can be at a temperature of from about 600 to about 800 F at a pressure of from atmospheric to 100 psig, and contain, for example, an overall steam/hydrocarbon ratio of from about 0.1 to about 2, preferably from about 0.1 to about 1, pounds of steam per pound of hydrocarbon.

In vaporization zone 13, dilution ratios (hot gas/liquid droplets) will vary widely because the compositions of crude oil, fractions of crude oil (particularly resid), and condensate vary widely. Generally, the hot gas, e.g., steam and hydrocarbon at the top of zone 13 can be present in a ratio of steam to hydrocarbon of from about 0.1/1 to about 5/1.

Steam is an example of a suitable hot gas introduced by way of line 21. Stream 6 can be that type of steam normally used in a conventional cracking plant. Other materials can be present in the steam employed. All such gases are preferably at a temperature sufficient to volatilize a substantial fraction of the liquid hydrocarbon 15 that enters zone 13. Generally, the gas entering zone 13 from conduit 21 will be at least about 650 F, preferably from about 900 to about 1,200 F at from atmospheric to 100 psig. Such gases will, for sake of simplicity, hereafter be referred to in terms of steam alone.

Stream 17 can, therefore, be a mixture of steam, acid species, and hydrocarbon vapor that has a boiling point lower than about 1,100 F. Stream 17 can be at a temperature of from about 600 to about 800 F at a pressure of from atmospheric to 100 psig.

Steam from line 21 does not serve just as a diluent for partial pressure purposes as is the normal case in a cracking operation. Rather, steam from line 21 provides not only a diluting function, but also additional vaporizing and mild cracking energy for the hydrocarbons that remain in the liquid state in unit 11. This is accomplished with just sufficient energy to achieve vaporization and/or mild cracking of heavier hydrocarbon components such as those found in whole crude oil and resid. For example, by using steam in line 21, substantial vaporization/mild cracking of feed 2 liquid is achieved. The very high steam dilution ratio and the highest temperature steam are thereby provided where they are needed most as liquid hydrocarbon droplets move progressively lower in zone 13.

Pursuant to this invention, hydrocarbons boiling lighter (lower) than about 1,100 F and acid species, all as defined hereinabove, remaining in the feed 10 of FIG. 1 will be vaporized in unit 11 and removed by way of either line 14 or 17 or both and fed to furnace 1 as described hereinabove. In addition, hydrocarbonaceous entities heavier than the lighter entities mentioned above in this paragraph can, at least in part, be mildly cracked or otherwise broken down in unit 11 to lighter hydrocarbonaceous entities such as those mentioned above, and those just formed lighter entities removed by way of line 17 as additional feed for furnace 1. The liquid remainder of feed 10, if any, is removed by way of line 26 for disposition elsewhere.

EXAMPLE

A Doba atmospheric residuum that has a TAN value of 4.5 is mixed in equal parts by weight with light gasoline and naphtha, resulting in a blend that has a TAN value of 2.25. This blend is fed into the preheat section 3 of the convection section of pyrolysis furnace 1. This feed mixture 2 is at 260 F and 80 psig. In this convection section feed 2 is preheated to about 690 F at about 60 psig, and then passes through line 10 into vaporization unit 11 wherein a mixture of gasoline, naphtha and gas oil gases at about 690 F and 60 psig is separated in zone 12 of that unit.

These separated gases are removed from zone 12 for transfer by way of line 25 to the convection preheat sub-zone 27 of the same furnace.

The hydrocarbon liquid remaining from resid based feed 2, after separation from accompanying hydrocarbon gases aforesaid, is transferred to lower section 13 by way of line 15 and allowed to fall downwardly in that section toward the bottom thereof.

Preheated steam 21 at about 1,050 F is introduced near the bottom of vaporization zone 13 to give a steam to hydrocarbon ratio in section 13 of about 1. The falling liquid droplets are in counter current flow with the steam that is rising from the bottom of zone 13 toward the top thereof. With respect to the liquid falling downwardly in zone 13, the steam to liquid hydrocarbon ratio increases from the top to bottom of section 19.

A mixture of steam and hydrocarbon vapor 17 at about 750 F is withdrawn from near the top of zone 13 and mixes with the gases earlier removed from zone 12 via line 14 to form a composite steam/hydrocarbon vapor stream 25 containing about 0.5 pounds of steam per pound of hydrocarbon present. This composite stream is preheated in sub-zone 27 to about 1,000 F at less than about 50 psig, and then passes into radiant firebox sub-zone 29 for cracking at a temperature in the range of 1,400° F. to 1,550° F. CO and $CO_2$ production is increased in the cracking furnace because of the conversion of naphthenic acids that are present in stream 25.

Bottoms product 26 of unit 11 is removed at a temperature of about 900F, and pressure of about 60 psig, and passes to the downstream processing equipment for further processing as desired.

Significant amounts of organic acids, including naphthenic acids, end up in stream 25, and are thereafter converted to CO, $CO_2$, and lower molecular weight acids in the cracking furnace.

At the same time additional vaporous feed for that cracking furnace are formed by the vaporization of additional amounts of liquid feed by way of the operation of vaporization unit 11, particularly vaporization zone 13.

We claim:

1. A method for thermally cracking a hydrocarbonaceous feedstock comprising the steps of:

(i) preheating the hydrocarbonaceous feedstock in a liquid cracking furnace to form a preheated stream, wherein the hydrocarbonceous feed stock comprises at least one hydrocarbonaceous material, at least one hydrocarbonaceous material containing at least one organic acid species, wherein the preheated stream comprises a first gaseous phase and a first liquid phase, (ii) passing the preheated stream from the liquid cracking furnace to the vaporization furnace;

(iii) separating the first gaseous phase and the first liquid phase in a upper vaporization zone of the vaporization furnace;

(iv) mixing the first liquid phase with steam that is preheated in the liquid cracking furnace to produce a second gaseous phase and a second liquid phase;

(v) combining the first gaseous phase and the second gaseous phase to produce a third gaseous phase;

(vi) preheating the third gaseous phase in a convection pre-heat sub-zone of the liquid cracking furnace; and (vii) thermally cracking the preheated third gaseous phase to form a cracked product wherein the chemical composition of the first gaseous phase is different from the chemical composition of the second gaseous phase, and wherein the first liquid phase is different from the second liquid phase.

2. The method of claim 1 wherein said hydrocarbonaceous feedstock has a TAN of at least about 1.0 mg KOH/g feedstock.

3. The method of claim 1 wherein said hydrocarbonaceous feedstock has a TAN of at least about 0.5 mg KOH/g feedstock.

4. The method of claim 1 wherein said hydrocarbonaceous feedstock is at least one of whole crude oil, condensate, residuum, and mixtures of two or more thereof.

5. The method of claim 1 wherein said hydrocarbonaceous feedstock is at least one atmospheric residuum.

6. The method of claim 1 wherein said at least one organic acid species includes at least one carboxylic acid species.

7. The method of claim 6 wherein said at least one carboxylic acid species includes at least one naphthenic acid species.

8. The method of claim 1 wherein the first liquid phase is subjected to a temperature in the range of from about 700 to about 1,100 F.

* * * * *

UNITED STATES PATENT AND TRADEMARK OFFICE

CERTIFICATE OF CORRECTION

PATENT NO. : 8,721,872 B2
APPLICATION NO. : 12/383990
DATED : May 13, 2014
INVENTOR(S) : Donald H. Powers et al.

It is certified that error appears in the above-identified patent and that said Letters Patent is hereby corrected as shown below:

Claims

| | | |
|---|---|---|
| Column 11 | Line 8 | In Claim 1, delete "hydrocarbonceous" and insert --hydrocarbonaceous-- |

Signed and Sealed this
Twenty-ninth Day of March, 2016

Michelle K. Lee

Michelle K. Lee
*Director of the United States Patent and Trademark Office*